US007000269B2

(12) United States Patent
Borda

(10) Patent No.: US 7,000,269 B2
(45) Date of Patent: Feb. 21, 2006

(54) ADJUSTABLE BASE FOR SUPPORTING ADJUSTABLE BEDS OF DIFFERENT WIDTHS

(75) Inventor: German Borda, Brandon, FL (US)

(73) Assignee: L&P Property Management Company, CA (US)

( * ) Notice: Subject to any disclaimer, the term of this patent is extended or adjusted under 35 U.S.C. 154(b) by 0 days.

(21) Appl. No.: 10/621,337

(22) Filed: Jul. 18, 2003

(65) Prior Publication Data

US 2005/0011005 A1 Jan. 20, 2005

(51) Int. Cl.
*A47C 19/04* (2006.01)

(52) U.S. Cl. ..... 5/412; 5/200.1; 5/181

(58) Field of Classification Search ..... 5/412, 5/200.1, 201, 181
See application file for complete search history.

(56) References Cited

U.S. PATENT DOCUMENTS

| | | | | | |
|---|---|---|---|---|---|
| 2,956,290 | A | | 10/1960 | Scheinerman | |
| 3,127,649 | A | | 4/1964 | Linsenmayer | |
| 3,736,602 | A | * | 6/1973 | Miller | 5/176.1 |
| 3,745,596 | A | * | 7/1973 | Copeland | 5/308 |
| 3,761,970 | A | * | 10/1973 | Fredman | 5/181 |
| 3,824,638 | A | * | 7/1974 | Bogar, Jr. | 5/181 |
| 3,961,383 | A | * | 6/1976 | Spitz | 5/181 |
| 3,984,884 | A | * | 10/1976 | Spitz | 5/176.1 |
| 4,019,211 | A | * | 4/1977 | Spitz | 5/181 |
| 4,027,343 | A | * | 6/1977 | Hooker | 5/200.1 |
| 4,106,141 | A | * | 8/1978 | Hooker | 5/201 |
| 4,225,265 | A | * | 9/1980 | Hooker et al. | 403/353 |
| 4,354,287 | A | * | 10/1982 | Fredman | 5/185 |
| 4,381,571 | A | | 5/1983 | Elliott | |
| 4,385,410 | A | | 5/1983 | Elliott et al. | |
| 4,386,871 | A | * | 6/1983 | Hooker et al. | 403/377 |
| 4,407,030 | A | | 10/1983 | Elliott | |
| 4,463,463 | A | | 8/1984 | Kaneko | |
| 4,534,077 | A | | 8/1985 | Martin | |
| 4,724,554 | A | | 2/1988 | Kowalski et al. | |
| 4,928,332 | A | | 5/1990 | Ogden et al. | |
| 4,942,633 | A | * | 7/1990 | Thomas et al. | 5/11 |
| 4,998,939 | A | | 3/1991 | Potthast et al. | |
| 5,163,968 | A | * | 11/1992 | Lafferty | 5/200.1 |
| 5,230,113 | A | | 7/1993 | Foster et al. | |
| 5,305,482 | A | | 4/1994 | Dewert | |
| 5,481,769 | A | | 1/1996 | Schneider | |

(Continued)

FOREIGN PATENT DOCUMENTS

GB 2205232 A 12/1988

*Primary Examiner*—Robert G. Santos
(74) *Attorney, Agent, or Firm*—Diller, Ramik & Wight

(57) ABSTRACT

An adjustable base is utilized with articulated or adjustable beds of different widths and includes first and second pairs of support brackets with each pair including first and second support brackets in opposing aligned relationship to each other. Each pair of support brackets is fastened at one end to a bed foundation and a second end of each support bracket has an elongated slot for fastening thereto cross rails of a bed-adjusting mechanism. The latter permits the utilization of a single size bed-adjusting mechanism for beds of different widths, permits mixing/matching bed foundations and bed-adjusting mechanisms of different manufacturers, and effects facile assembly.

54 Claims, 10 Drawing Sheets

U.S. PATENT DOCUMENTS 5,537,701 A 7/1996 Elliott
5,625,913 A 5/1997 Singleton
5,758,372 A * 6/1998 Lopez Diaz ..... 5/200.1
5,870,784 A 2/1999 Elliott
5,931,532 A 8/1999 Kemmerer et al.
5,996,145 A * 12/1999 Taylor ..... 5/200.1
6,061,852 A 5/2000 Bathrick et al.
6,091,217 A 7/2000 Parsadayan
6,201,481 B1 3/2001 Bellingroth
6,209,157 B1 4/2001 Hensley
6,210,863 B1 4/2001 Cunningham et al.
6,276,011 B1 8/2001 Antinori
6,564,401 B1 * 5/2003 Weinman ..... 5/53.1
6,851,140 B1 * 2/2005 Polevoy et al. ..... 5/200.1
2005/0011005 A1 * 1/2005 Borda ..... 5/412

* cited by examiner

ADJUSTABLE BASE FOR SUPPORTING ADJUSTABLE BEDS OF DIFFERENT WIDTHS

BACKGROUND OF THE INVENTION

The invention is directed to an adjustable base for an adjustable bed and more specifically to an adjustable base which can be utilized to support the adjusting mechanism of adjustable beds of different widths. Typical of such adjustable beds are those disclosed in the following patents:

U.S. Pat. No. 2,956,290
U.S. Pat. No. 3,127,649
U.S. Pat. No. 4,381,571
U.S. Pat. No. 4,385,410
U.S. Pat. No. 4,407,030
U.S. Pat. No. 4,463,463
U.S. Pat. No. 4,928,332
U.S. Pat. No. 5,425,150
U.S. Pat. No. 5,537,701
U.S. Pat. No. 5,870,784
U.S. Pat. No. 6,061,852
U.S. Pat. No. 6,209,157 B1
U.S. Pat. No. 6,219,863 B1
U.S. Pat. No. 6,276,011 B1
GB Patent No. 2,205,232 A The latter patents disclose articulated beds of the type in which the present invention can be utilized in order that any particular bed-adjusting mechanism can be utilized with beds of different widths. More specifically, the adjustable base of the present invention can support thereon a bed-adjusting mechanism of the type disclosed in any of the latter patents for utilization with conventional adjustable beds of differing transverse dimensions, such as twin, queen, king, etc.

The present invention also renders more versatile the adjustable or articulated bed disclosed in application Ser. No. 10/226,337 entitled "A UNIVERSAL ADJUSTABLE BED" filed on Aug. 23, 2002 in the names of Adam M. Weinman and German Borda. The latter patent application pointed out that virtually all conventional adjustable beds require components of different dimensions for each bed size which in turn requires excessive inventory and corresponding increased cost of manufacture, assembly and shipment thereof. This is particularly true if such beds are not shipped in an operative assembled condition which would then require end users to be relatively sophisticated to assemble the beds from individual components thereof. Though the latter patent application satisfies the desirability of reducing components for manufacturing and/or assembling different bed sizes, the latter is accomplished primarily by the utilization of longitudinal supporting members in a bed foundation which are spaced a predetermined transverse distance from each other irrespective of whether the adjustable bed is a narrower bed (twin) or a wider bed (king). By establishing a standard width dimension for all articulated beds between the longitudinal supporting members thereof upon which the bed-adjusting mechanism is supported, the only further requirement is changing the width of the bed foundations and the mattress support panels to accommodate twin, king, etc. mattresses. Therefore, no matter the size of the bed or the bed foundation, the same universal bed-adjusting mechanism can be dropped into the bed foundation or bed frame to form a twin, queen, king or like articulated bed of differing transverse dimensions (double twin, queen, king, etc.). One disadvantage of the latter-described bed-adjusting mechanism is the necessity of maintaining precise dimensions between the points at which the adjustable bed mechanism is bolted or otherwise secured to its associated support frame. Moreover, since the attachment points of the adjustable bed mechanism and the support frame are a single standard dimension, the adjustable bed mechanism cannot be utilized in association with conventional beds (non-adjustable), bed foundations, bed frames or mattress frames which differ from the established transverse dimension, conventional head board and foot board frames, etc., particularly when manufactured by different bed manufacturers utilizing different transverse (width) dimensions. It would be obviously highly desirable to provide a mechanism for associating virtually any bed-adjusting mechanism with virtually any bed frame, bed foundation or mattress frame for virtually any size bed manufactured by any bed manufacturer.

SUMMARY OF THE INVENTION

The invention is directed to an adjustable base which can be utilized with virtually any bed-adjusting mechanism of an adjustable or articulated bed or with a standard conventional bed foundation or box spring support irrespective of the particular size of the bed, such as twin, double twin, queen, king, etc.

The adjustable base of the present invention which is particularly adapted for utilization with beds of different widths, particularly adjustable or articulated beds having bed-adjusting mechanisms, includes first and second pairs of support brackets each defined by a side rail having first and second support brackets secured to opposite ends of the side rail. The first and second support brackets of each pair are in opposing relationship to each other and are supported along opposite side supports of a bed foundation, a mattress support, or the like. The bed-adjusting mechanism is supported upon the support brackets and end portions of the support brackets have elongated slots through which fasteners pass to secure the support brackets to the bed-adjusting mechanism. The elongated slots and fasteners of the support brackets adapt bed-adjusting mechanisms of the same or differing widths as may be associated with different size beds, such as twin, queen, king, etc. No matter the particular width of the bed-adjusting mechanism and specifically the points at which the specific bed-adjusting mechanism is to be attached to the support brackets, the elongated slots in the latter allow the fasteners to move therein laterally nearer or further away from each other to respectively accommodate narrower and wider bed-adjusting mechanisms and/or bed or mattress supports and/or head boards and foot boards for respectively narrower (twin) and wider (king) beds.

Due to the specific construction of the support brackets, specifically the elongated slots therein, the same can not only be utilized by a manufacturer of articulated or adjustable beds, but a conventional bed manufacturer can fasten the bed-adjusting mechanism to a conventional mattress support or foundation by utilizing two pairs of the support brackets. Therefore, a manufacturer of articulating beds which normally include a bed foundation in which is housed and to which if fastened a bed-adjusting mechanism might well supply the bed-adjusting mechanism and pairs of the support brackets to the industry or directly to end users for fastening to opposite side rails of conventional (non-adjustable) beds. Therefore, by utilizing two pairs of the support brackets, a bed-adjusting mechanism for virtually any width bed can be utilized in association with a "drop-in" bed foundation, as set forth in the latter pending patent application, or with a conventional (non-adjustable) bed or with a conventional mattress support or with conventional head board/foot board and side rail beds.

In further accordance with the present invention, the support bracket is preferably of a Z-shaped configuration defined by opposite end portions and a medial portion therebetween with the opposite end portions lying in offset substantially parallel planes. One end portion of the support bracket is connected to a bed foundation, a conventional bed frame, a mattress support or the like, while an opposite end portion of each bracket includes an elongated slot for connecting the same to a specific bed adjusting mechanism for a specific width bed.

Preferably, the support brackets are utilized in pairs. A bracket side rail is welded or otherwise connected between the one end portions of each pair of support brackets, and the opposite end portions having the elongated slots therein are supported in opposing transverse spaced relationship to each other. A bed-adjusting mechanism can simply be "dropped-in" to and upon the support bracket opposite end portions and fastened thereto by fasteners passing through the elongated slots. The bed foundation to which the pairs of support brackets is attached could be specifically constructed and dimensioned for the specific bed-adjusting mechanism associated therewith. However, the bed foundation could be a conventional head board and foot board spanned by side rails to which the support brackets are fastened. This would permit a bed-adjusting mechanism to be connected to such a conventional head board/foot board bed.

In further accordance with the invention, the one end portion of the support brackets can each carry a female socket for receiving a stem of a caster or wheel, and the opposite end portions thereof can be directly connected to a bed-adjusting mechanism. In this manner, the adjustable bed is basically supported only by the bed-adjusting mechanism and the wheeled/castered support brackets fastened thereto.

With the above and other objects in view that will hereinafter appear, the nature of the invention will be more clearly understood by reference to the following detailed description, the appended claims and the several views illustrated in the accompanying drawings.

DETAILED DESCRIPTION OF THE PREFERRED EMBODIMENTS

Figure 1:
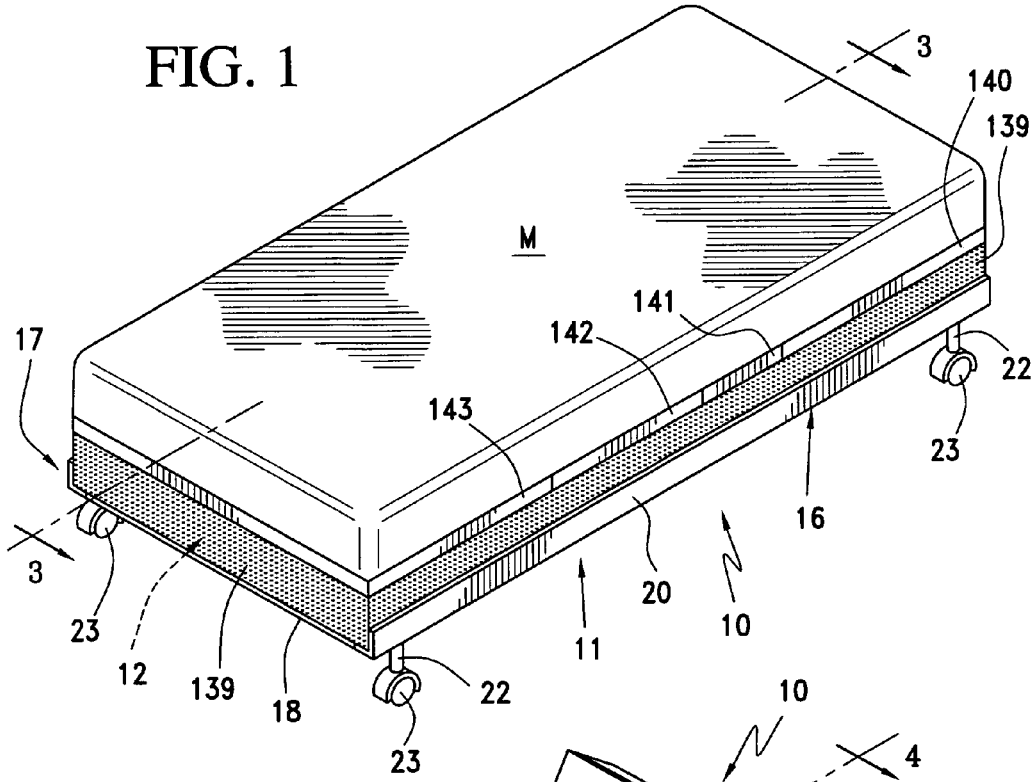
FIG. 1 is a fragmentary top perspective view of an adjustable or articulated bed constructed in accordance with this invention, and illustrates a mattress supported upon head, seat, thigh and foot boards disposed in a generally prone position upon a bed-adjusting mechanism which is in turn supported upon a conventional wheeled bed/mattress frame.

A novel adjustable bed constructed in accordance with this invention is illustrated in FIGS. 1 through 6 of the drawings and is generally designated by the reference numeral 10. The adjustable or articulated bed 10 includes a bed foundation 11 and a universal adjusting bed mechanism 12 (FIGS. 3 through 6) supporting a mattress M.

Figure 2:
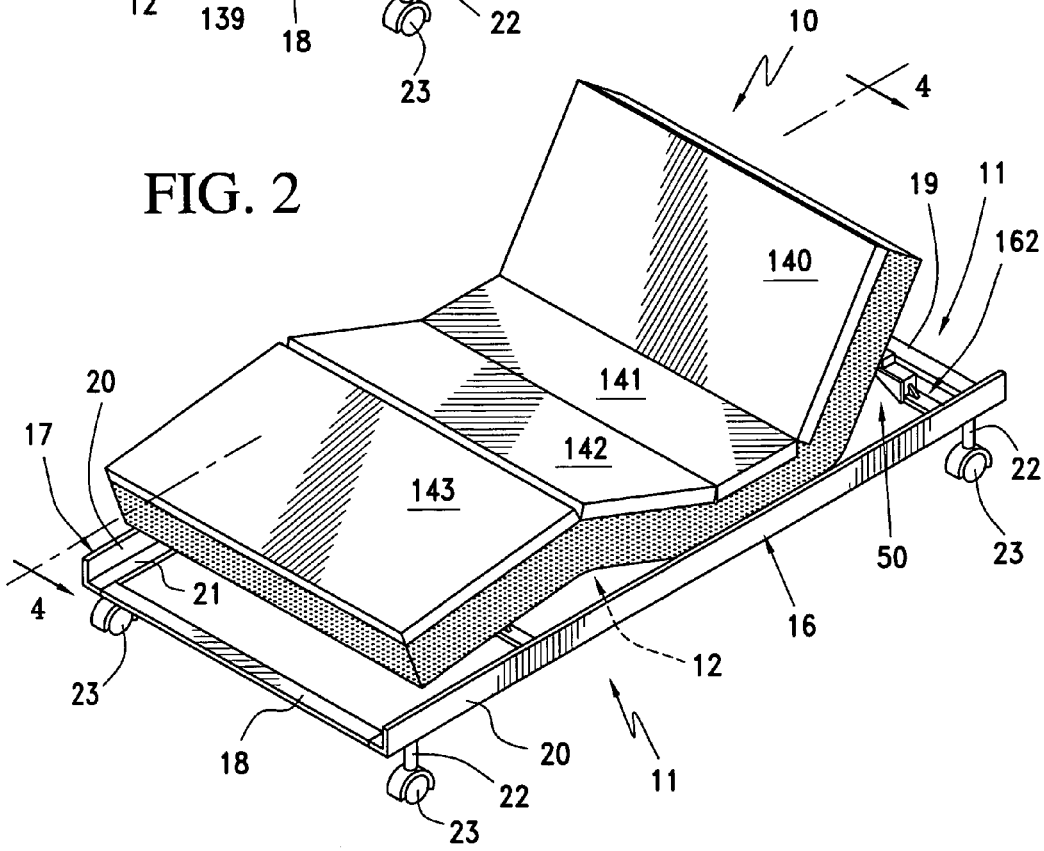
FIG. 2 is a perspective view of the adjustable or articulated bed of FIG. 1 with the mattress removed for clarity, and illustrates the head, seat, thigh and foot boards moved from the a prone position of FIG. 1 to the adjusted position of FIG. 2 and one of four support brackets associated with the bed-adjusting mechanism.
Figure 3:
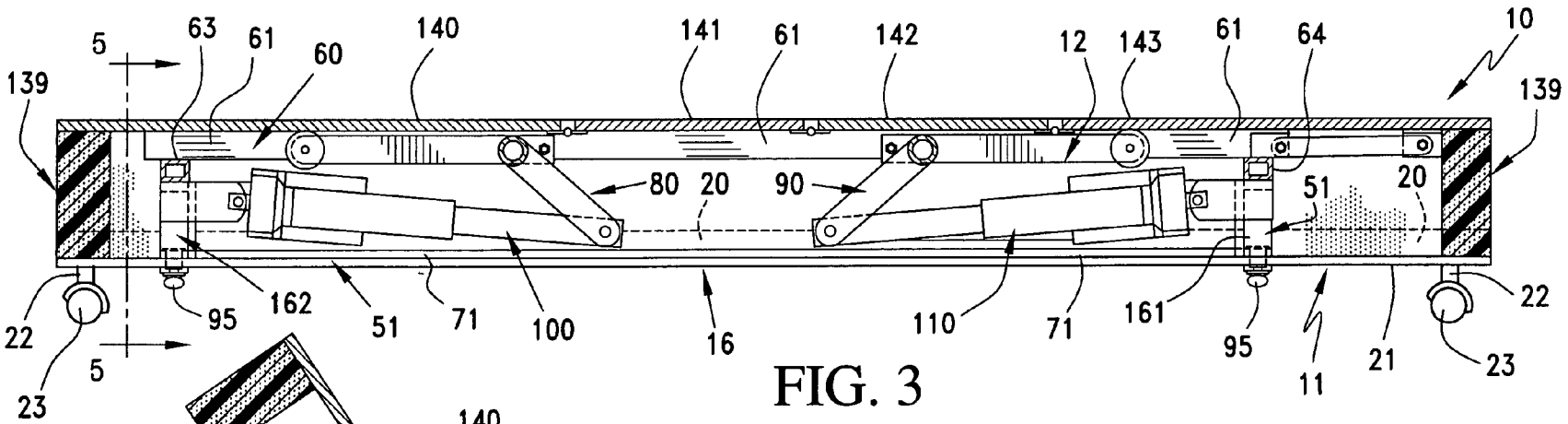
FIG. 3 is an enlarged longitudinal cross-sectional view taken generally along line 3—3 of FIG. 1, and illustrates a bed-adjusting mechanism, including its support frame and head board and foot board adjusting linkage and drive mechanisms therefor supported upon one of a pair of support brackets of the present invention which are in turn secured to one of opposite side rails of the conventional wheeled bed or mattress frame.
Figure 4:
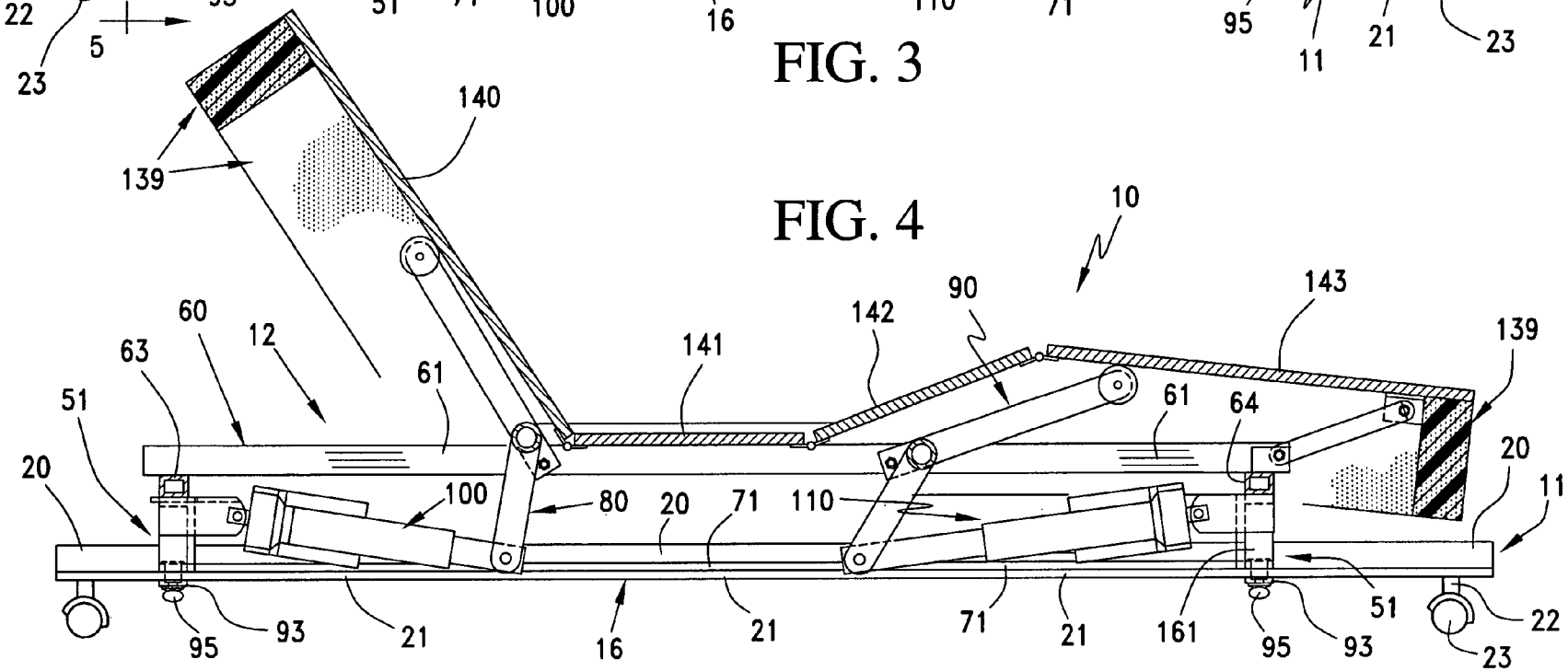
FIG. 4 is an enlarged longitudinal cross-sectional view taken generally along line 4—4 of FIG. 2, and illustrates the various components moved to an adjusted position.
Figure 5:
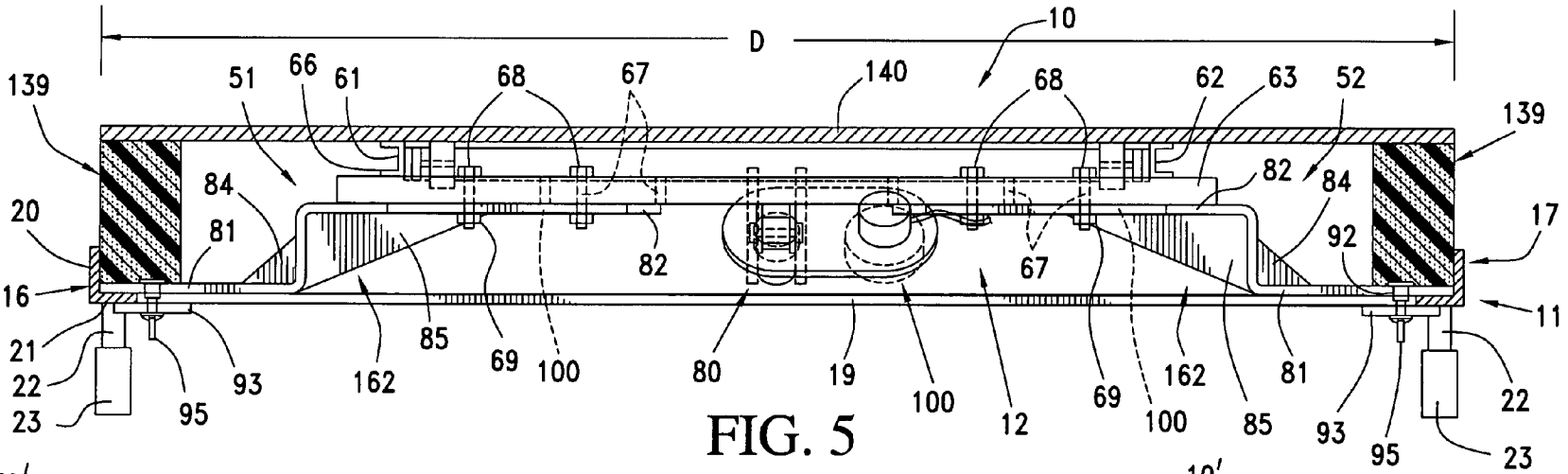
FIG. 5 is an enlarged fragmentary cross-sectional view taken generally along line 5—5 of FIG. 3 with parts removed for clarity, and illustrates two support brackets of the invention in opposing relationship to each other underlyingly supporting and fastened to a transverse support rail at a head end of the bed.

The bed foundation 11 is of a conventional construction and is of the type upon which a box spring is supported and which in turn supports a conventional mattress (not shown). The bed foundation 11 is formed as a rigid metal skeletal frame structure, though the same can be of a conventional foldable construction and includes opposite substantially parallel side rails 16, 17 welded at ends (unnumbered) thereof to ends of opposite generally parallel end rails 18, 19 (FIG. 2). Further transverse cross rails (not shown) located in spaced parallel relationship to each other and to and between the end rails 18, 19 can be welded to the side rails 16, 17 for added rigidity. Each side rail 16, 17 is an angle iron defined by vertical and horizontal flanges 20, 21, respectively (FIG. 5). Tubular female connectors 22 (FIGS. 1, 2 and 5) are welded to the underside of the horizontal flanges 21 of the side rails 16, 17, and each receives a stem (not shown) of a conventional wheel or caster 23.

The bed-adjusting mechanism 12 corresponds substantially identically to the bed-adjusting mechanism identically numbered in the latter-identified patent application, and the details thereof are incorporated hereat by reference, particularly the support 60 (FIGS. 3 through 6) defined by opposite substantially parallel longitudinal side rails 61, 62 and spaced substantially parallel transverse head and foot rails 63, 64, respectively, welded thereto. The side rails 61, 62 are generally of a C-shaped, cross-sectional configuration (FIG. 5) which open away from each other and lower flanges 66 thereof are welded to the head and foot rails 63, 64, respectively. Opposite end portions (unnumbered) of the head and foot rails 63, 64 have a plurality of spaced openings 67 (FIGS. 5, 6 and 7) through which fasteners 68 (FIGS. 5 and 7) can pass for a purpose to be described hereinafter.

The bed-adjusting mechanism 12 further includes a headboard adjusting linkage mechanism 80, a foot board adjusting linkage mechanism 90 and respective drive mechanisms 100, 110 (FIGS. 3–6) associated therewith corresponding to the identically numbered mechanisms disclosed in U.S. Pat. No. 6,061,852, the structure, function and description of which are incorporated hereat by reference. The latter drive mechanisms 100, 110 through the respective linkage mechanisms 80, 90 selectively adjust or articulate the adjustable bed 10 between the prone or horizontal position illustrated in FIG. 1 and one of many different positions of adjustment (FIG. 2). Such movement is translated to head, seat, thigh and foot boards 140 through 143, respectively, which are pivotally connected to each other and to various portions and linkages of the bed-adjusting mechanism 12, again as is more specifically disclosed in the latter-identified patent and pending application. A depending peripheral skirt 139 constructed from relatively flexible synthetic polymeric/copolymeric plastic material is bonded to the underside (unnumbered) of the boards 140 through 143 to hide the bed-adjusting mechanism 12 in the prone or horizontal position of the bed 10, as is apparent from FIG. 1 of the drawings. Preferably, the boards or panels 140 through 143 and the peripheral skirt 139 are covered by a cloth fabric which can be quilted to impart a mattress-like appearance thereto.

The most important aspect of the novel and unobvious adjustable bed 10 of the present invention is an adjustable support base or an adjustment-providing support base 50 (FIG. 6) which is adapted for utilization with beds of different widths (compare FIGS. 5 and 8) which utilize the same size bed-adjusting mechanism 12.

Figure 6:
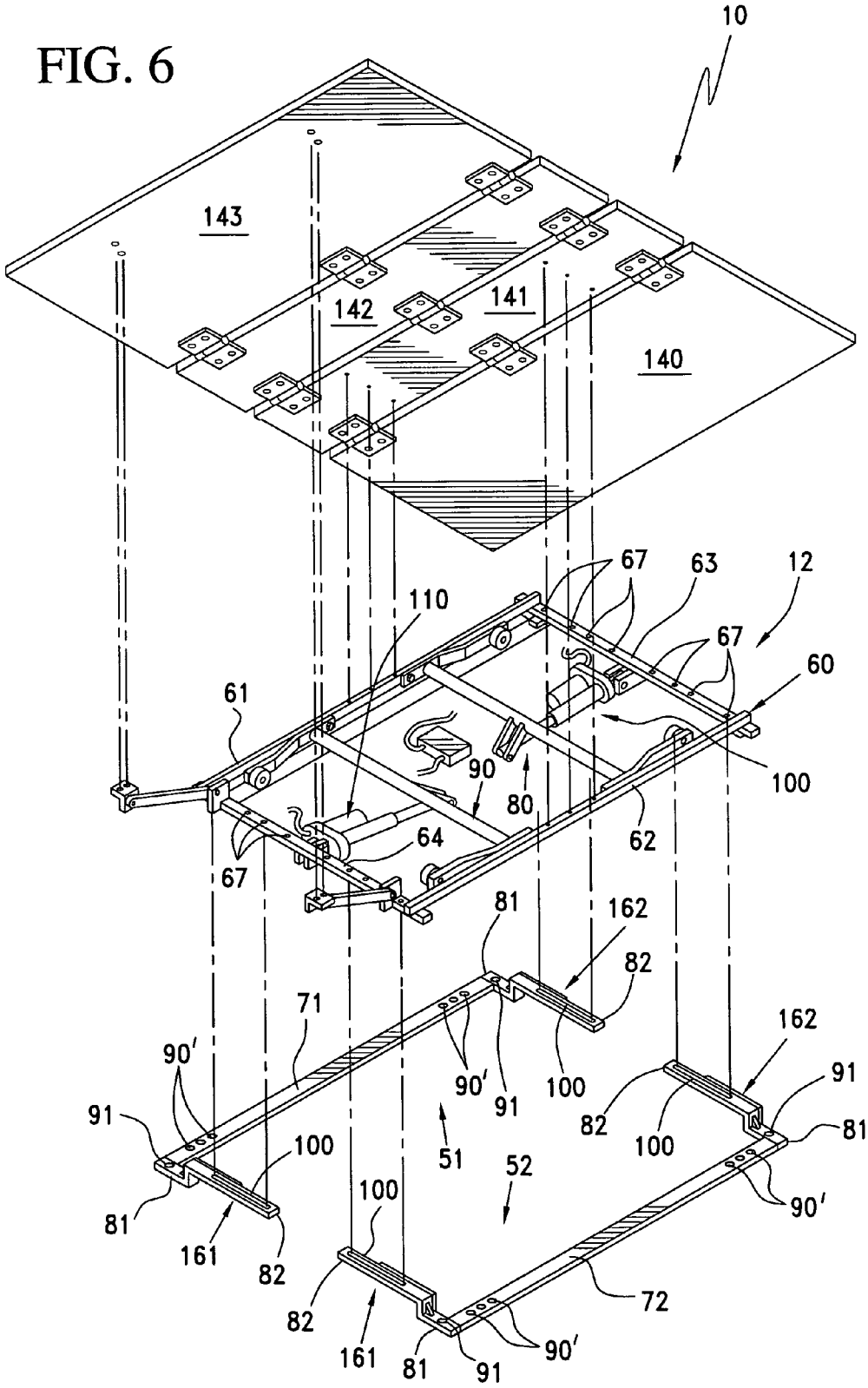
FIG. 6 is a perspective exploded view of the adjustable or articulated bed of the invention, and illustrates the adjustable base in the form of first and second pairs of support brackets with each pair including a first and second support bracket interconnected by a rail, a bed-adjusting or articulating mechanism, and head, seat, thigh and foot boards hinged together prior to the assembly of the latter components.

The adjustable base 50 is constructed of metal and includes first and second pairs 51, 52 of support brackets. The first and second pairs 51, 52 of support brackets each include first and second support brackets 161, 162 with the first support brackets 161 being in aligned coplanar opposing relationship to each other and the second support brackets 162 being similarly in aligned planar opposing relationship to each other (FIG. 6). Each first and second pair 51, 52 of support brackets 161, 162 includes respective means 71, 72 for interconnecting the first and second support brackets 161, 162 thereof. The interconnecting means 71, 72 are each a relatively rigid metal plate welded to and between the associated support brackets 161, 162 (FIGS. 6 and 7) of each pair 51, 52 of support brackets 161, 162.

Figure 7:
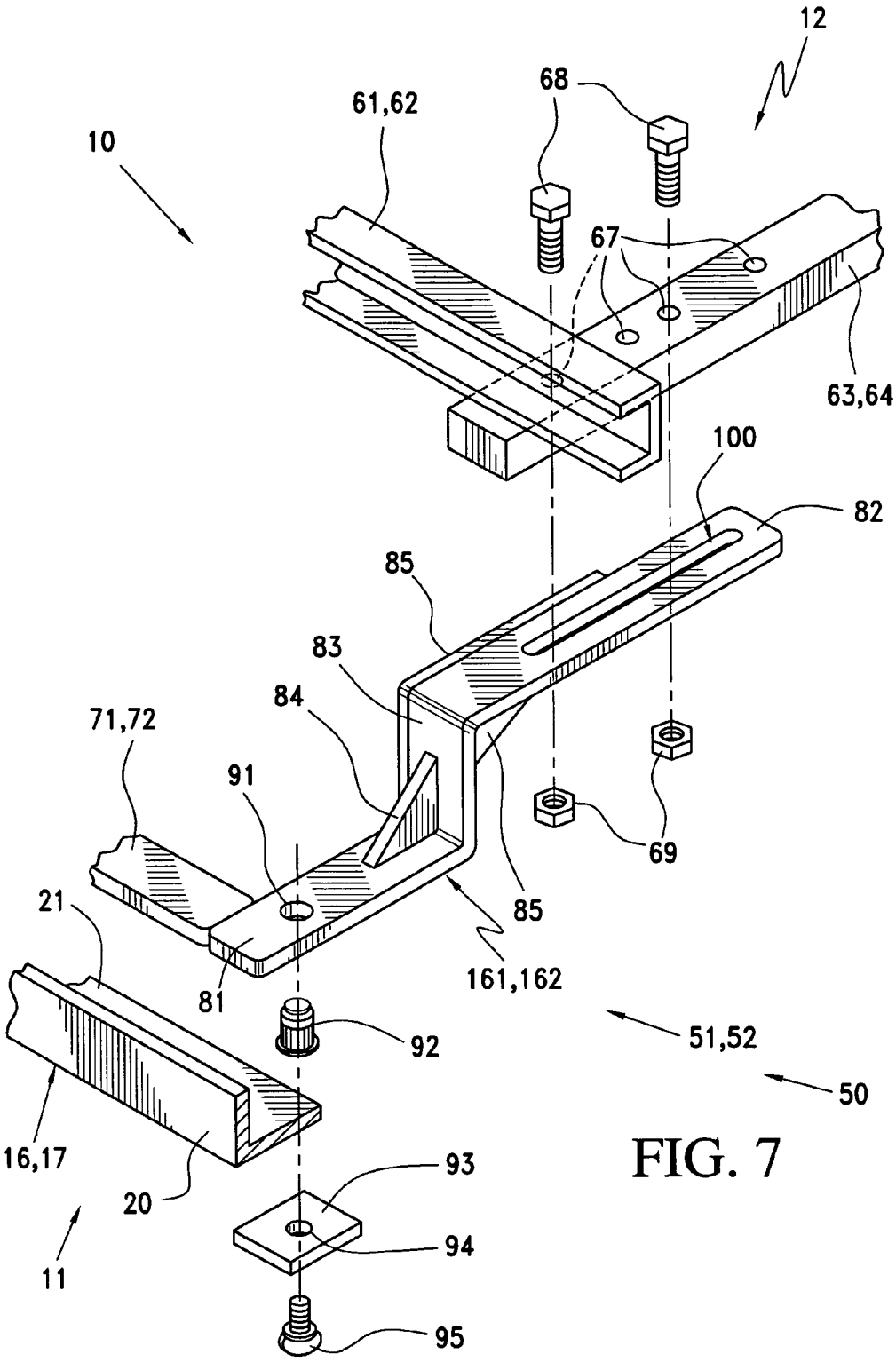
FIG. 7 is an enlarged exploded fragmentary perspective view of a corner of the adjustable base, and illustrates one of four identical Z-shaped support brackets each including an opening and an elongated slot in opposite offset substantially parallel end portions thereof.
Figure 9:
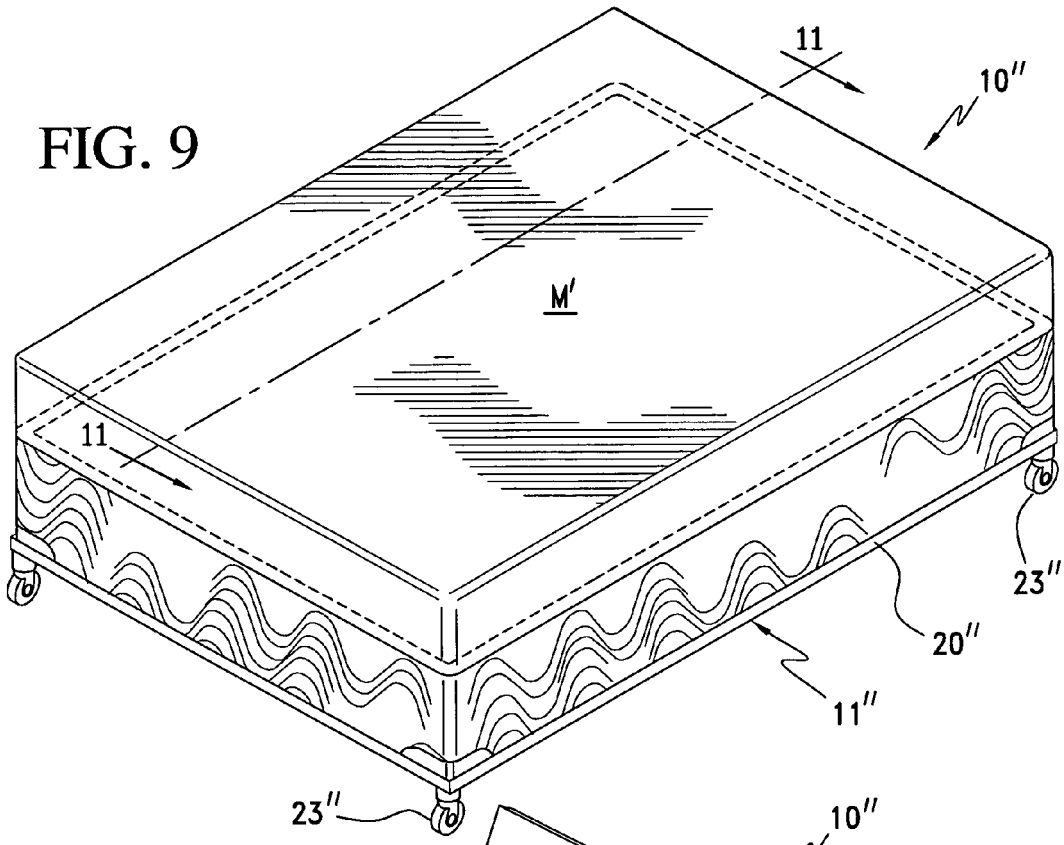
FIG. 9 is a fragmentary top-perspective view of another adjustable bed constructed in accordance with this invention and illustrates an exteriorly padded/quilted bed foundation, a bed-adjusting mechanism within the bed foundation and a mattress supported upon head, seat, thigh and foot boards of the bed-adjusting mechanism.
Figure 10:
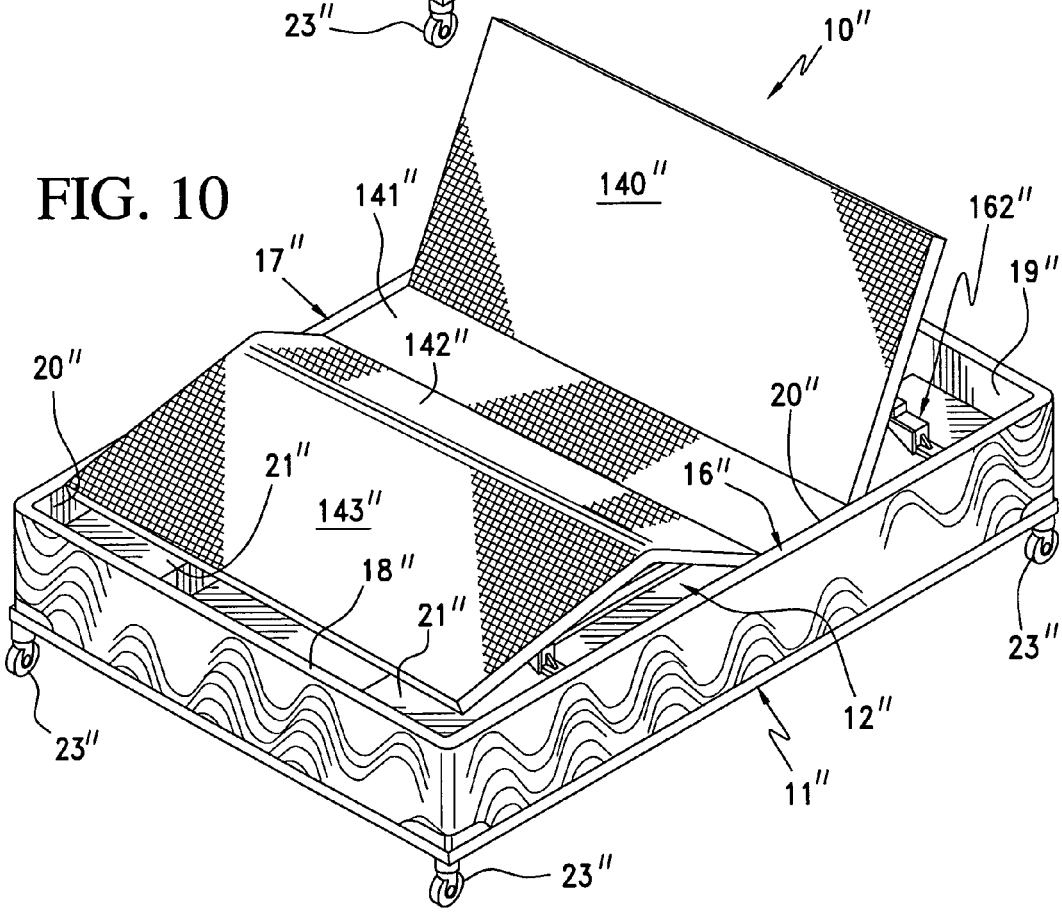
FIG. 10 is a perspective view of the adjustable bed of FIG. 9, and illustrates the head, seat, thigh and foot boards moved from the prone position of FIG. 1 to one of several different adjustable positions with the mattress removed for clarity and one of four support brackets supporting the bed-adjusting mechanism.
Figure 11:
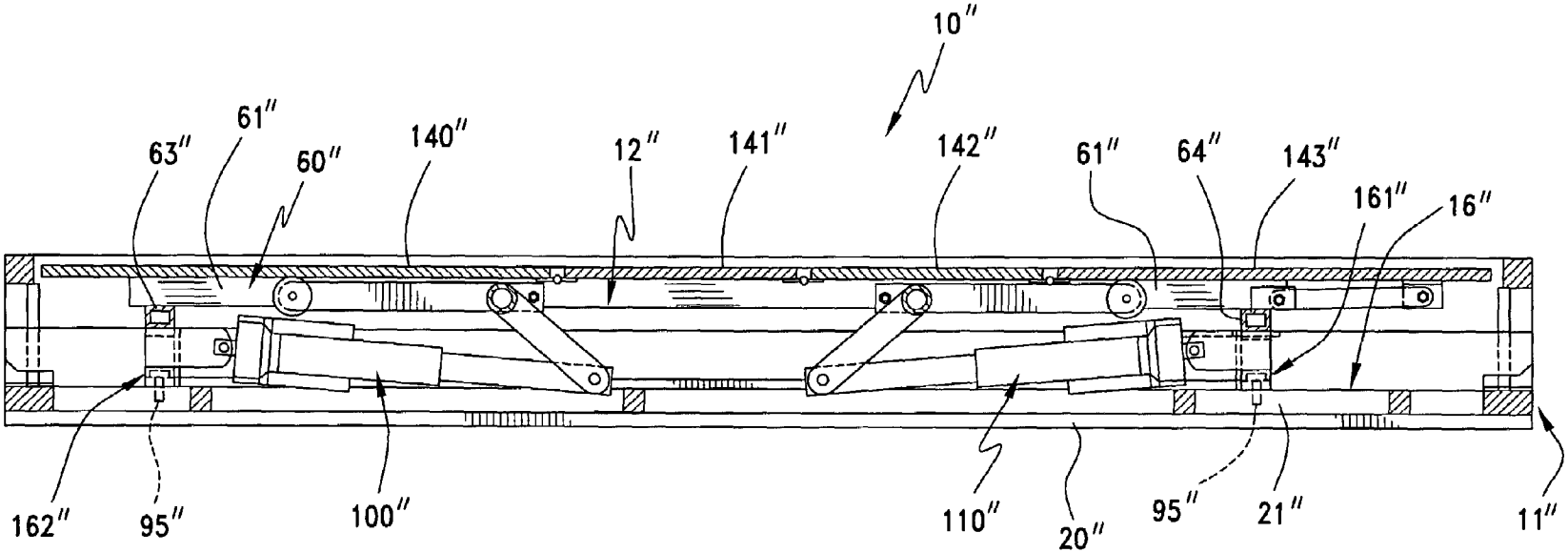
FIG. 11 is an enlarged longitudinal cross-sectional view taken generally along line 11—11 of FIG. 9, and illustrates the manner in which the bed-adjusting mechanism is supported by a pair of support brackets within a chamber of the bed foundation.
Figure 12:
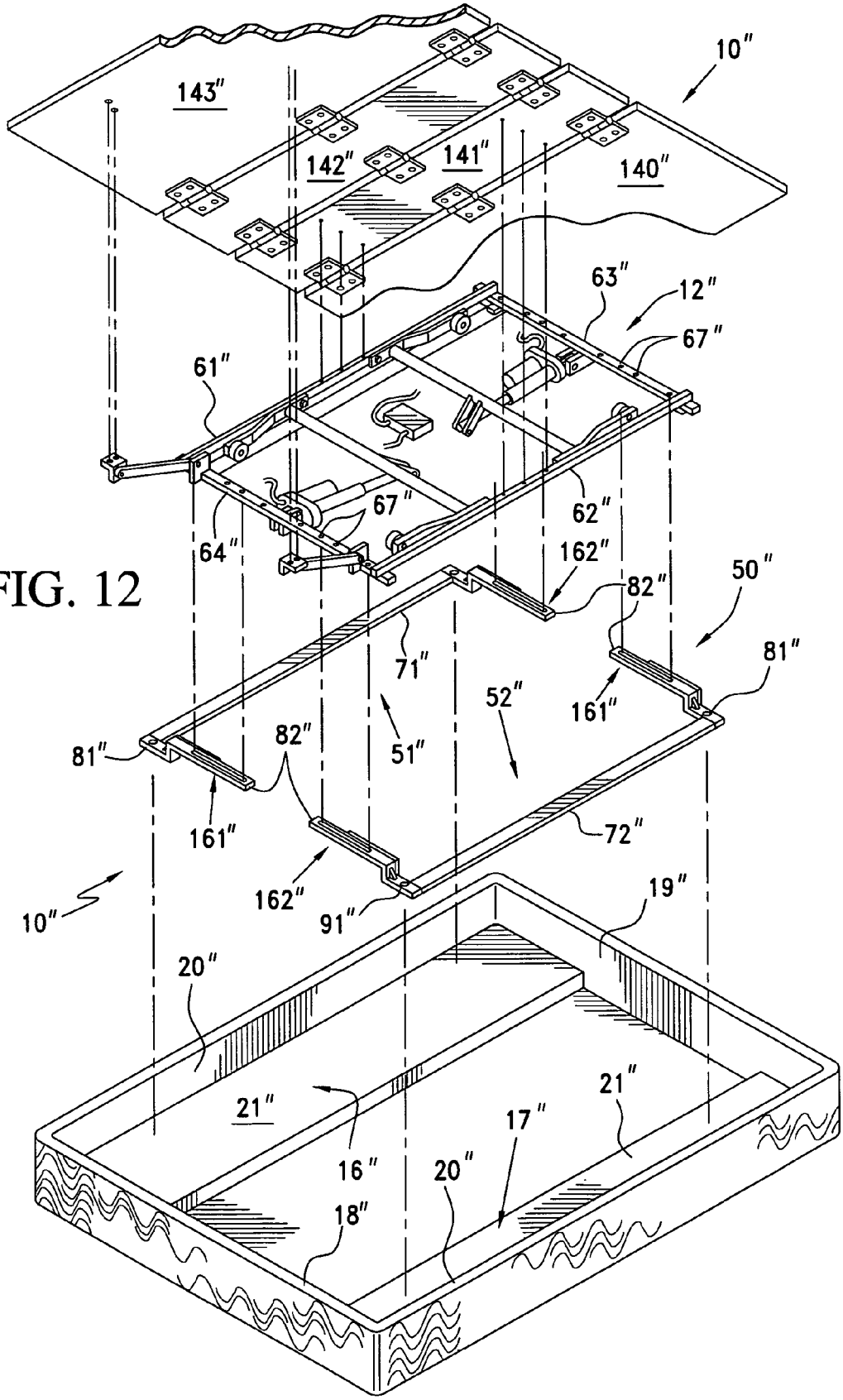
FIG. 12 is an exploded perspective fragmentary view of the adjustable or articulated bed of FIGS. 9 through 11, and illustrates two pair of support brackets prior to being fastened to the bed adjusting mechanism and being dropped-in and secured within the chamber of the bed foundation.

As is best illustrated in FIG. 7 of the drawings, each support bracket 161, 162, which is preferably constructed from relatively rigid metal, is of a substantially Z-shaped configuration defined by first and second opposite end portions 81, 82, respectively, and a medial portion 83 therebetween. The opposite end portions 81, 82 are disposed in substantially parallel spaced horizontal planes. Reinforcing means 84, 85 in the form of relatively rigid triangular metallic plates are welded to and between the respective first and second end portions 81, 82, respectively, and the medial portion 83 to impart rigidity to each of the support brackets 161, 162.

The first end portion 81 of each of the support brackets 61, 62 includes means 90 for securing the pair 51, 52 of first and second support brackets 161, 162 to the horizontal flanges 21 of the side rails 16, 17 of the bed foundation 11 (FIGS. 5 and 7). The securing means 90 include an opening or aperture 91 in the first end portion 81 of each support bracket 161, 162 into which is forced-fit an internally threaded female socket 92; a plate 93 having an opening or aperture 94 and a thumb screw 95 or equivalents thereof. Each plate 93 is positioned beneath the horizontal flange 21 of the side rails 16, 17 (FIG. 5) after which the thumb screw is passed through the opening 94 of the plate 93 and is threaded into the female socket 92 which rigidly clamps each of the pair 51, 52 of support brackets 161, 162 to the respective side rails 16, 17, as is most readily apparent from FIG. 5 of the drawings. Though the hole 90 is formed in the end portion 81 of each support brackets 161, 162, like or additional holes can be formed in and/or along the horizontal flanges 21 of the side rails 71, 72, as is indicated by openings or apertures 90' in FIG. 6. The specific location and number of the apertures 90, 90' can be varied.

After the adjustable base 50 and specifically the pairs 51, 52 of support brackets 161, 162 have been secured to the respective side rails 16, 17 of the bed foundation 11, the bed adjusting mechanism 12 with the head, back, seat and thigh boards 140–143, respectively, assembled thereto is lowered upon the adjustable base with the head and foot rail 63, 64, respectively, aligned with the support brackets 162, 162, and 161, 161, respectively, as is readily apparent from FIGS. 3 through 7 of the drawings. The latter alignment brings selected ones of the apertures or openings 67 of the rails 63, 64 into alignment with means 100 (FIG. 7) of each of the brackets 161, 162 for effecting variable fastener locations for the fasteners 68 depending upon the particular size/width of the associated adjustable bed 10. The means 100 in each second end portion 82 of each support bracket 161, 162 is an elongated aperture or slot through which the fasteners 68 pass after passing through the apertures or openings 67 (FIG. 7) of the rails 63, 64 and to which can be threaded conventional nuts 69 (FIG. 7) which when tightened rigidly attach the bed-adjusting mechanism 12 to the adjustable base 50.

Figure 8:
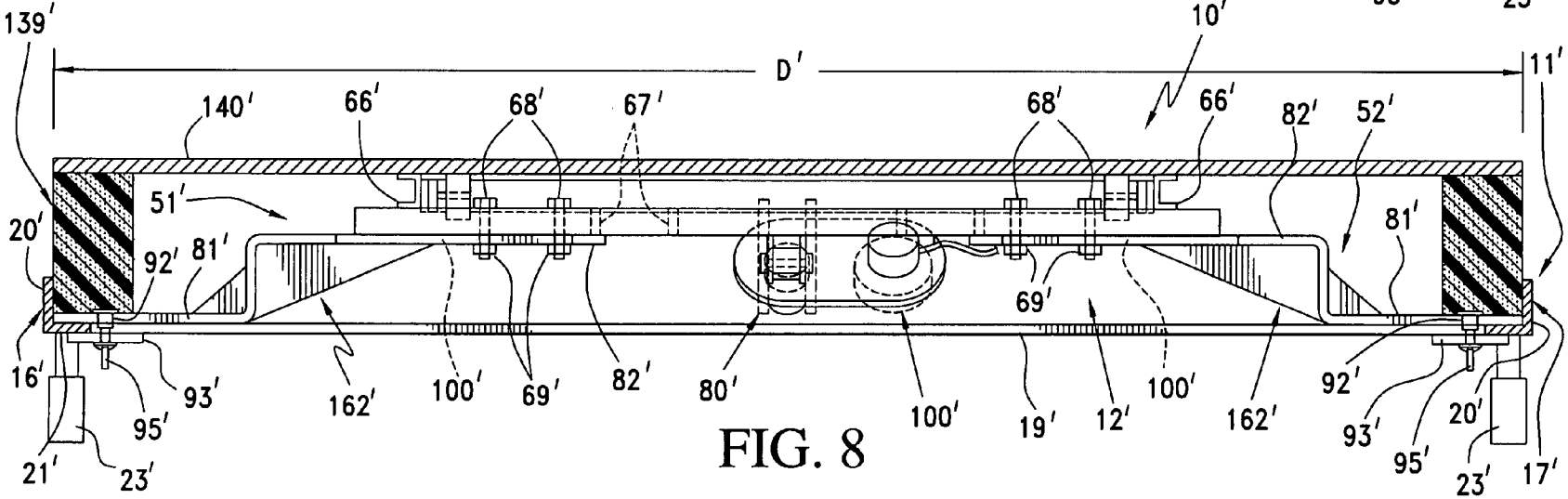
FIG. 8 is a fragmentary cross-sectional view with parts removed for clarity taken along a line corresponding to line 5—5 of FIG. 3 of a wider adjustable bed, and illustrates two support brackets of the invention in opposing relationship to each other underlyingly supporting and fastened to a transverse support rail at a head end of the wider bed.

Reference is made to FIG. 5 of the drawings in which the width of the overall adjustable bed 10 is defined by a distance D as measured substantially between the vertical flanges 20 of the side rails 16, 17. The distance D is, for example, 38" which corresponds to the width of a twin bed. A twin bed is the narrowest manufactured bed to which the invention is directed, and, when utilized therewith, the support brackets 61, 62 are positioned as close to each other as possible. However, because of the plurality of openings 67 (FIG. 7) in the rails 63, 64 and the length of the elongated slot 100, the adjustable support 50 can be utilized with wider adjustable or articulated beds, such as the wider adjustable bed 10' of FIG. 8, noting the transverse dimension D' thereof. The only difference between the two beds 10, 10' of respective FIGS. 5 and 8 are the widths D, D' thereof which is accommodated in the adjustable bed 10' by spacing the ends of the support brackets 161', 161' and 162', 162' in FIG. 8 further from each other than that shown in FIG. 5, as is readily apparent from the comparison of the two figures. Preferably, the distance between the furthest of the four openings 67 in the end portions of each rail 63, 64 is approximately six inches and the length of each elongated slot 100 of each support bracket 161, 162 is approximately 6⅜" which is an effective adjusting distance of approximately 24¾" which in turn establishes an approximate two foot difference between the narrowest and the widest beds with which the adjustable base 50 can be associated. Just as importantly is the fact that the approximate 24¾" of adjustment will readily accommodate for any errors in manufacturing tolerances and, more importantly, would allow the bed-adjusting mechanisms 12 of different manufacturers which have variances in width to be utilized with standard or conventional bed foundations 11 and to be assembled thereto by simply drilling appropriate holes in the rails corresponding to the holes 67 of the rails 63, 64 of the bed-adjusting mechanism 12. The adjustable base 50 can, therefore, be utilized by the assignee of this invention with adjustable beds of different widths. More importantly, because of the construction of the adjustable base 50 just described, the adjustable base 50 can be utilized with articulated beds of other manufacturers whose adjustable bases vary in width within the two foot adjustment provided by the adjustable base 50. The approximate two foot adjustment of the adjustable base 50 also permits the latter to be utilized with conventional bed frames, such as the bed frame 11, or specialty bed frames designed specifically for adjustable beds. In other words, the adjustable base 50 can be utilized with a conventional bed frame, such as the bed frame 11, or a drop-in bed foundation specifically designed for an adjustable bed, as will be described hereinafter, or with a modification thereto, the adjustable base 50 can also be utilized with numerous conventional head board and foot board bed frames absent a rail 71, 72 of the adjustable base 50, as will also be described hereinafter.

Figure 13:
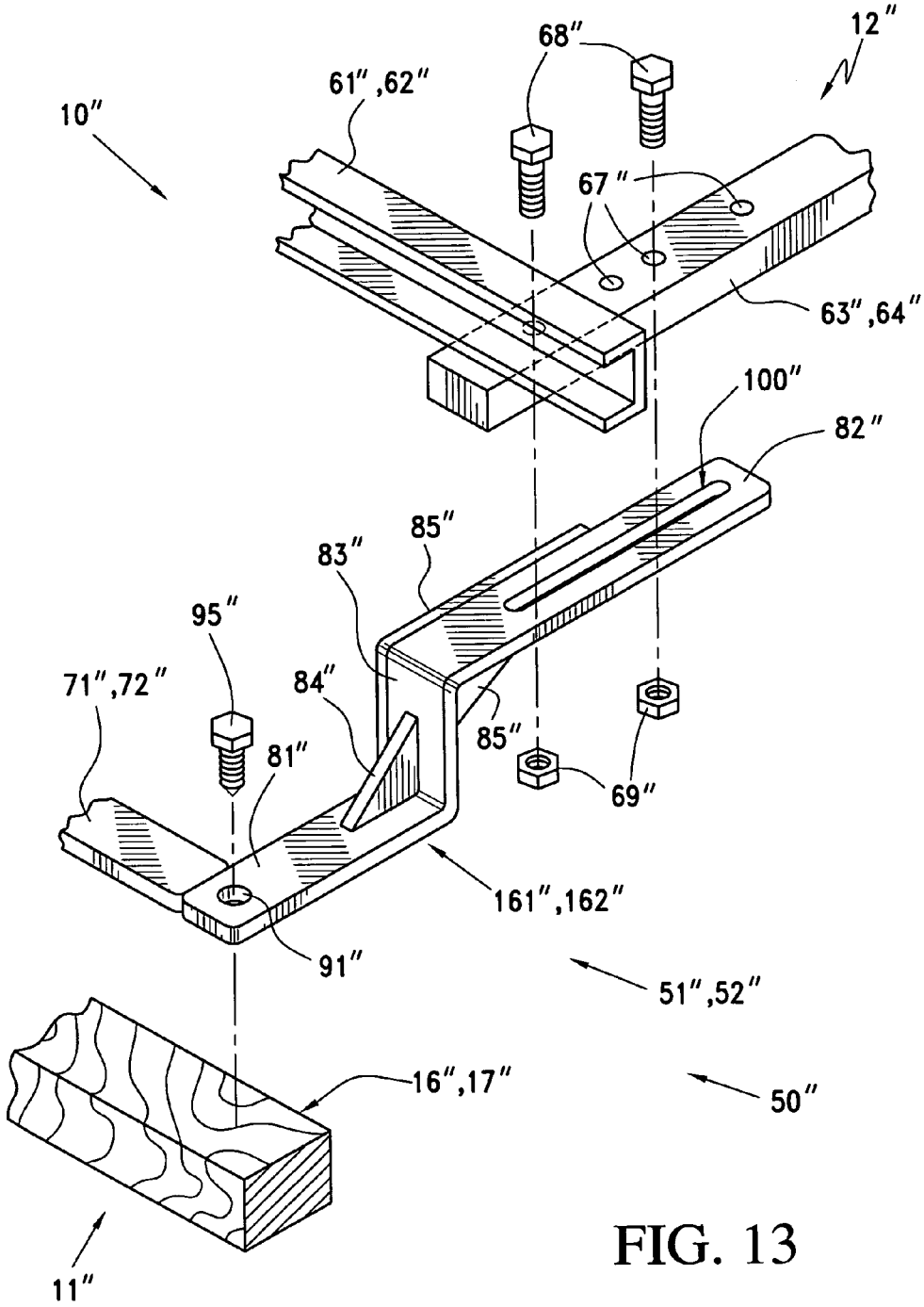
FIG. 13 is an enlarged exploded fragmentary perspective view of one of four support brackets at a corner of the adjustable bed, and illustrates the manner in which the support bracket can be fastened to a transverse support rail of the bed-adjusting mechanism and a side rail of the bed foundation.

Another adjustable or articulated bed constructed in accordance with this invention is illustrated in FIGS. 9 through 12 of the drawings and is generally designated by the reference numeral 10 with primed reference numerals identifying components of the adjustable bed 10" identical to like unprimed reference numerals of the adjustable bed 10. The adjustable bed 10" is constructed substantially identically to the adjustable bed of the latter-noted pending application, and, as noted earlier herein, the disclosure thereof is herein incorporated by reference. However, in the adjustable bed of the latter-identified patent application, the bed adjusting mechanism is fastened directly to the bed foundation whereas in the bed 10" of FIGS. 9 through 11, and as more specifically illustrated in FIGS. 12 and 13, an adjustable base 50" including pairs of support brackets 161", 162" and elongated members 71", 72" welded therebetween are fastened identically to rails 63", 64" (FIG. 13), as was heretofore described with respect to FIG. 7 in particular. The securing means 90" (FIG. 13) are similarly utilized to secure each of the pairs 51", 52" of support brackets 161", 162" to opposite wooden side rails 16", 17" of the bed foundation 11". However, instead of utilizing the female socket 92, the plate 93 and the thumb screw 95 (FIG. 7) of the adjustable base 50, a wood screw 95" is inserted through each opening 91" and is securely fastened to an associated side rail 16", 17" of the bed foundation 11".

Figure 14:
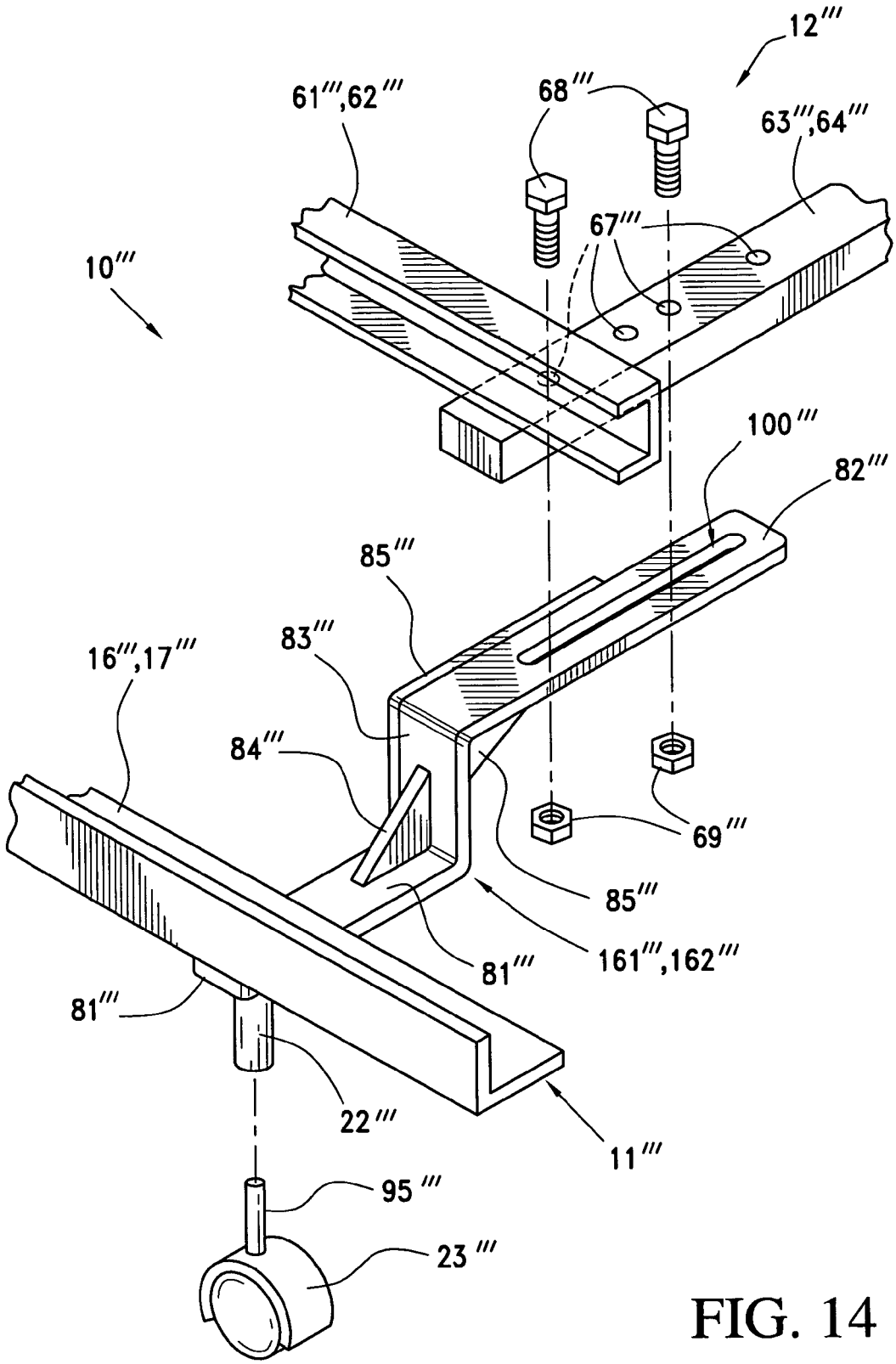
FIG. 14 is a fragmentary exploded perspective view similar to FIGS. 7 and 13, but illustrates a support bracket welded to a side rail of a bed or mattress frame at one of two ends of the latter and a female tubular connector welded to the underside of an end portion of the support bracket for reception of the stem of a caster/wheel.

A portion of another adjustable or articulatable bed 10''' constructed in accordance with this invention is illustrated in FIG. 14 which illustrates one of four corners thereof. Triple primed reference characters in FIG. 14 correspond to identical structure of FIG. 7 and differ therefrom by the absence of the fastening or securing means 90 including the opening 91, the female socket 92, the plate 93 and the thumb screw 95 in support brackets 161''', 162'''. Instead of the latter, a tubular female wheel/caster socket 22''' is welded to the underside (unnumbered) of the first end portion 81''' of each of the support brackets 161''', 162''' and receives therein a stem 95''' of a wheel/caster 23". The location of the female sockets 22''' are closer to each other than that illustrated with respect to the female sockets 22, 22 in FIGS. 3 and 4 and are instead located at the position of the thumb screws 95, 95 to obviously locate the support brackets 161''', 162''' in underlying alignment with the associated rails 63''', 64'''. The support brackets 161''', 162''' are interconnected in opposing pairs (not shown) by the elongated members 171''', 172''' welded therebetween, and transverse rails 63''', 64''' of the bed-adjusting mechanism 12''' are fastened thereto by fasteners or threaded bolts 68''' and associated nuts 69''', just as described with respect to the bed-adjusting mechanism 12 and the support brackets 61, 62 and/or 161, 162. However, the pairs 51''', 52''' of the support brackets 161''', 162''' are not supported upon a bed frame but instead define a bed frame or bed foundation 11''' which can be utilized by simply supporting a mattress (not shown) upon the body-supporting panels (not shown) corresponding to the body-supporting panels 140–143 of the adjustable bed 10.

In further keeping with the present invention, each of the side rails 16, 17 can have pairs of downwardly directed hooks or equivalent fastening means for engaging in slots of conventional head boards and foot boards to adapt any of the adjustable beds herein described for attachment to such conventional head board and foot board bed frames. Alternatively, such conventional head boards and foot boards can be connected by separate conventional means to any of the bed foundations heretofore described and/or to the transverse rails 18, 19, for example, thereof.

In further accordance with this invention, any of the support brackets 161, 162; through 161''', 162''' can be utilized absent the associated rails 71, 72; 71", 72", etc. In such cases, the bed adjusting mechanism 12 is fastened to the supporting base 50 of FIG. 7, for example, and wheels, casters or supports can be appropriately secured in the opening or aperture 91 of each of the support brackets 161, 162. Obviously, the rails or elongated members 71, 72, etc. of the earlier described supporting bases 50, 50', etc. have been eliminated in the bed 10''' of FIG. 14.

Although preferred embodiments of the invention have been specifically illustrated and described herein, it is to be understood that minor variations may be made in the apparatus without departing from the spirit and scope of the invention, as defined by the appended claims.

What is claimed is:

1. An adjustable base adapted for utilization with beds of different widths comprising first and second pairs of support brackets, each first and second pair of support brackets including first and second support brackets, said first and second support brackets of each pair being disposed in substantially parallel relationship to each other, said first and second support brackets of said first pair of support brackets being disposed in substantially aligned opposing spaced unconnected relationship with said first and second support brackets respectively of said second pair of support brackets, and each of said first and second support brackets of each pair of support brackets including means for effecting variable fastener locations whereby said first and second pairs of support brackets can be selectively variably spaced from each other to accommodate utilization with beds of different widths.

2. The adjustable base as defined in claim 1 including means for interconnecting the first and second support brackets of each first and second pair of support brackets.

3. The adjustable base as defined in claim 1 including means for interconnecting the first and second support brackets of each first and second pair of support brackets, and each of said interconnecting means includes an elongated member.

4. The adjustable base as defined in claim 1 including means for interconnecting the first and second support brackets of each first and second pair of support brackets, and each of said interconnecting means includes a side rail.

5. The adjustable base as defined in claim 1 including means for interconnecting the first and second support brackets of each first and second pair of support brackets, each of said interconnecting means includes an elongated member, and said elongated members are disposed in substantially parallel relationship to each other.

6. The adjustable base as defined in claim 1 including means for interconnecting the first and second support brackets of each first and second pair of support brackets, each of said interconnecting means includes a side rail, and said side rails are disposed in substantially parallel relationship to each other.

7. The adjustable base as defined in claim 1 wherein said variable fastener locations effecting means is aperture means associated with each of said first and second support brackets.

8. The adjustable base as defined in claim 1 wherein said variable fastener locations effecting means is elongated aperture means associated with each of said first and second support brackets.

9. The adjustable base as defined in claim 1 including means for securing each of said first and second support brackets to a bed frame.

10. The adjustable base as defined in claim 1 including means for securing each of said first and second support brackets to a side rail of a bed frame.

11. The adjustable base as defined in claim 1 wherein each of said first and second support brackets is of a substantially identical construction.

12. The adjustable base as defined in claim 1 wherein each of said first and second support brackets includes first and second substantially opposite end portions, said first and second support brackets first end portions each include means for securing said first and second support brackets to a bed frame, and said first and second brackets second end portions each include said variable fastener locations effecting means.

13. The adjustable base as defined in claim 1 wherein each of said first and second support brackets includes first and second substantially vertically offset opposite end portions.

14. The adjustable base as defined in claim 1 wherein each of said first and second support brackets includes first and second substantially vertically offset opposite end portions and a medial portion therebetween.

15. The adjustable base as defined in claim 1 wherein each of said first and second support brackets includes first and second substantially offset opposite end portions and a medial portion therebetween defining a substantially Z-shaped configuration.

16. The adjustable base as defined in claim 1 wherein each of said first and second support brackets includes first and second substantially vertically offset opposite end portions and a medial portion therebetween; and means between at least the medial portion and one of the offset opposite end portions of said first and second support brackets for reinforcing the same.

17. The adjustable base as defined in claim 1 wherein each of said first and second support brackets includes first and second substantially vertically offset opposite end portions and a medial portion therebetween; and means between the medial portion and each of the offset opposite end portions of said first and second support brackets for reinforcing the same.

18. The adjustable base as defined in claim 1 wherein each of said first and second support brackets includes first and second substantially vertically offset opposite end portions and a medial portion therebetween; and means in the form of a substantially rigid reinforcing plate between at least the medial portion and one of the offset opposite end portions of said first and second support brackets for reinforcing the same.

19. The adjustable base as defined in claim 1 wherein each of said first and second support brackets includes first and second substantially vertically offset opposite end portions and a medial portion therebetween; and means in the form of a substantially rigid reinforcing plate between the medial portion and each of the offset opposite end portions of said first and second support brackets for reinforcing the same.

20. The adjustable base as defined in claim 7 wherein each of said first and second support brackets includes first and second substantially opposite end portions, said first and second support brackets first end portions each include means for securing said first and second support brackets to a bed frame, and said first and second brackets second end portions each include said variable fastener locations effecting means.

21. The adjustable base as defined in claim 10 wherein each of said first and second support brackets includes first and second substantially vertically offset opposite end portions.

22. The adjustable base as defined in claim 20 wherein each of said first and second support brackets includes first and second substantially vertically offset opposite end portions and a medial portion therebetween.

23. The adjustable base as defined in claim 20 wherein each of said first and second support brackets includes first and second substantially offset opposite end portions and a medial portion therebetween defining a substantially Z-shaped configuration.

24. The adjustable base as defined in claim 20 wherein each of said first and second support brackets first and second substantially opposite end portions are vertically offset with a medial portion therebetween; and means between at least the medial portion and one of the vertically offset opposite end portions of said first and second support brackets for reinforcing the same.

25. The adjustable base as defined in claim 20 wherein each of said first and second support brackets first and second substantially opposite end portions are vertically offset with a medial portion therebetween; and means between the medial portion and each of the vertically offset opposite end portions of said first and second support brackets for reinforcing the same.

26. The adjustable base as defined in claim 20 wherein each of said first and second support brackets first and second substantially opposite end portions are vertically offset with a medial portion therebetween; and means in the form of a substantially rigid reinforcing plate between at least the medial portion and one of the vertically offset opposite end portions of said first and second support brackets for reinforcing the same.

27. The adjustable base as defined in claim 20 wherein each of said first and second support brackets first and second substantially opposite end portions are vertically offset with a medial portion therebetween; and means in the form of a substantially rigid reinforcing plate between the medial portion and each of the vertically offset opposite end portions of said first and second support brackets for reinforcing the same.

28. The adjustable base as defined in claim 20 wherein each of said first and second support brackets is of a substantially identical construction.

29. The adjustable base as defined in claim 20 wherein said bed frame defines a chamber within which said adjustable base is located, and an exterior of said chamber is defined by means for effecting a mattress appearance thereto.

30. An adjustable bed comprising a bed frame, an adjustable base supported by said bed frame, said adjustable base including first and second pairs of support brackets, each first and second pairs of support brackets including first and second support brackets, said first and second support brackets of each pair being disposed in substantially parallel relationship to each other, said first and second support brackets of said first pair of support brackets being disposed in substantially aligned opposing spaced unconnected relationship with said first and second support brackets respectively of said second pair of support brackets, each of said first and second support brackets of each pair of support brackets including means for effecting variable fastener locations whereby said first and second pairs of support brackets can be selectively variably spaced from each other to accommodate utilization with beds of different widths, bed-adjusting means supported by said adjustable base, and means for fastening said bed-adjusting means to said adjustable base utilizing said variable fastener locations effecting means.

31. The adjustable bed as defined in claim 30 wherein said variable fastener locations effecting means is aperture means associated with each of said first and second support brackets.

32. The adjustable bed as defined in claim 30 wherein each of said of said first and second support brackets includes first and second substantially opposite end portions, said first and second support brackets first end portions each include means for securing said first and second support brackets to said bed frame, and said first and second brackets second end portions each include said variable fastener locations effecting means.

33. The adjustable bed as defined in claim 30 wherein each of said first and second support brackets includes first and second substantially vertically offset opposite end portions.

34. The adjustable bed as defined in claim 30 wherein each of said first and second support brackets includes first and second substantially vertically offset opposite end portions and a medial portion therebetween.

35. The adjustable bed as defined in claim 30 wherein each of said first and second support brackets includes first and second substantially offset opposite end portions and a medial portion therebetween defining a substantially Z-shaped configuration.

36. The adjustable bed as defined in claim 30 wherein each of said first and second support brackets includes first and second substantially vertically offset opposite end portions and a medial portion therebetween; and means between at least the medial portion and one of the offset opposite end portions of said first and second support brackets for reinforcing the same.

37. The adjustable bed as defined in claim 30 wherein each of said first and second support brackets includes first and second substantially vertically offset opposite end portions and a medial portion therebetween; means between at least the medial portion and one of the vertically offset opposite end portions of said first and second support brackets for reinforcing the same, and said variable fastener locations effecting means is aperture means associated with at least one of said opposite end portions of said first and second support brackets.

38. The adjustable bed as defined in claim 37 wherein each of said first and second support brackets includes first and second substantially offset opposite end portions and a medial portion therebetween defining a substantially Z-shaped configuration.

39. The adjustable bed as defined in claim 37 wherein each of said first and second support brackets includes first and second substantially vertically offset opposite end portions and a medial portion therebetween; and means between at least the medial portion and one of the offset opposite end portions of said first and second support brackets for reinforcing the same.

40. An adjustable base adapted for utilization with beds of different widths comprising first and second pairs of support brackets, each first and second pair of support brackets including first and second support brackets, said first and second support brackets of each pair being disposed in substantially parallel relationship to each other, said first and second support brackets of said first pair of support brackets being disposed in substantially aligned opposing spaced unconnected relationship with said first and second support brackets respectively of said second pair of support brackets, each of said first and second support brackets of each pair of support brackets including means for effecting variable fastener locations whereby said first and second pairs of support brackets can be selectively variably spaced from each other to accommodate utilization with beds of different widths, and means for securing said support bracket to at least one of a head board and a foot board.

41. The adjustable base as defined in claim 40 wherein said securing means is a downwardly directed hook for receipt in a slot of at least one of a head board and a foot board.

42. An adjustable base comprising a bed frame; at least head, thigh and foot sections, means for selectively adjustably imparting movement to at least one of said head, thigh and foot sections; first support means for supporting said sections and said bed section movement imparting adjusting means, second support means for supporting said first support means relative to said bed frame, and means for effecting variable fastener locations between said first and second support means to thereby accommodate at least one of said first and second support means for utilization with beds of different widths.

43. The adjustable base as defined in claim 42 wherein said variable fastener location effecting means includes opening means in at least one of said first and second support means along which fasteners can be fastened at different selected relative positions between said first and second support means to effect utilization of the adjustable base with beds of different widths.

44. The adjustable base as defined in claim 42 wherein said variable fastener location effecting means includes opening means in each of said first and second support means along which fasteners can be fastened at different selected relative positions between said first and second support means to effect utilization of the adjustable base with beds of different widths.

45. The adjustable base as defined in claim 43 wherein said opening means includes at least one of an elongated opening and a series of openings.

46. The adjustable base as defined in claim 42 wherein said second support means includes first and second support brackets having opposite terminal end portions, and said variable fastener location effecting means includes opening means in each of said terminal end portions.

47. The adjustable base as defined in claim 42 wherein said second support means includes first and second support brackets having opposite terminal end portions, and said variable fastener location effecting means includes elongated opening means in each of said terminal end portions.

48. The adjustable base as defined in claim 42 wherein said support means includes first and second elongated side supports having at each of opposite terminal end portions thereof a transverse support portion, and said variable fastener location effecting means includes opening means in each of said opposite transverse support portions.

49. The adjustable base as defined in claim 47 wherein said opening means includes at least one of an elongated opening and a series of openings.

50. The adjustable base as defined in claim 48 wherein said transverse support portions are disposed in substantially transversely aligned opposing spaced relationship to each other.

51. The adjustable base as defined in claim 48 wherein said transverse support portions are disposed in substantially transversely aligned opposing spaced unconnected relationship to each other.

52. The adjustable base as defined in claim 51 wherein said opening means includes at least one of an elongated opening and a series of openings.

53. The adjustable bed as defined in claim 51 wherein said at least one opening means is elongated.

54. The adjustable bed as defined in claim 51 wherein said at least one opening means is a series of openings.

* * * * *